US005426718A

United States Patent [19]

Funaki et al.

[11] Patent Number: 5,426,718

[45] Date of Patent: Jun. 20, 1995

[54] SPEECH SIGNAL CODING USING CORRELATION VALVES BETWEEN SUBFRAMES

[75] Inventors: Keiichi Funaki; Kazunori Ozawa, both of Tokyo, Japan

[73] Assignee: NEC Corporation, Tokyo, Japan

[21] Appl. No.: 842,040

[22] Filed: Feb. 26, 1992

[30] Foreign Application Priority Data

Feb. 26, 1991 [JP] Japan ..... 3-103262

[51] Int. Cl.[6] ..... G10L 9/00

[52] U.S. Cl. ..... 395/2.25; 395/2.29; 395/2.3

[58] Field of Search ..... 381/29–41; 395/2.25–2.32

[56] References Cited

U.S. PATENT DOCUMENTS

| | | | |
|---|---|---|---|
| 4,736,428 | 4/1988 | Deprettere et al. | 381/38 |
| 4,932,061 | 6/1990 | Kroon et al. | 381/31 |
| 5,097,508 | 3/1992 | Valenzuela Steude et al. | 381/36 |
| 5,138,661 | 8/1992 | Zinser et al. | 381/35 |

*Primary Examiner*—Allen R. MacDonald
*Assistant Examiner*—Michelle Doerrler
*Attorney, Agent, or Firm*—Ostrolenk, Faber, Gerb & Soffen

[57] ABSTRACT

A speech signal coding system for coding a speech signal at a bit rate of 8 to 4 kb/s wherein the amount of calculation for fractional search of delays of an adaptive codebook is reduced significantly. Before a fractional delay of the adaptive codebook is found, candidates of integer delay are found by an open-loop using correlation values. A search for a fractional delay by a closed loop is performed for a search range for fractional delays which is provided by ±several samples of each integer delay candidate thus found using the correlation values. The fractional delay search is realized by polyphase filtering of an excitation signal in the past. In the search, a plurality of candidates of fractional delay may be found for each integer delay candidate from the adaptive codebook. In this instance, a fractional delay is determined decisively from the decimal delay candidates after a search of an excitation codebook.

3 Claims, 3 Drawing Sheets

SPEECH SIGNAL CODING USING CORRELATION VALVES BETWEEN SUBFRAMES

BACKGROUND OF THE INVENTION

1. Field of the Invention

This invention relates to a speech coding system for coding a speech signal with high quality at a low bit rate, specifically, at about 8 to 4.8 kb/s.

2. Description of the Prior Art

Various methods of coding a speech signal at a low bit rate of about 8 to 4.8 kb/s are already known. Exemplary one of such conventional coding methods is CELP (Code Excited Linear Prediction), which is disclosed, for example, in M. R. Schroeder and B. S. Atal, "CODE-EXCITED LINEAR PREDICTION (CELP): HIGH-QUALITY SPEECH AT VERY LOW BIT RATES", *Proc. ICASSP*, pp.937–940, 1985 (reference 1). According to this method, on the transmission side, a spectrum parameter representing a spectrum characteristic of a speech signal is extracted from a speech signal for each frame (e.g., 20 ms). Each frame is divided into subframes of, for example, 5 ms, and a pitch parameter representing a long-term correlation (pitch correlation) is extracted from a past excitation signal for each subframe. Then, long-term prediction (pitch prediction) of the speech. signal of the subframe is performed using the pitch parameter. A noise signal is selected from within a codebook which consists of predetermined different noise signals prepared in advance such that the error power between the speech signal and a signal synthesized using the selected signal may be minimized while an optimal gain is calculated. An index representative of the selected noise signal and the gain are transmitted together with the spectrum parameter and the pitch parameter. Description of construction and operation on the reception side is omitted herein.

Also various long-term prediction methods are already known. An exemplary method of such conventional long-term prediction methods uses an adaptive codebook such that excitation signals in the past are displaced successively one by one sample distance so that a value of such displacement (integer delay) which minimizes the squared error and a galn corresponding to the delay are found. The long-term prediction method just described is disclosed, for example, in W. Kleijn et al., "An Efficient Stochastically Excited Linear Predictive Coding Algorithm for High Quality Low Bit Rate Transmission of Speech", *Speech Communication*, 7, pp.305–316, 1988 (reference 2). With the long-term prediction method, however, the pitch period of an actual speech signal is not an integer multiple of a sampling frequency, and particularly when the voice is high (when the pitch period is short) as uttered by a female speaker, if it is tried to represent the pitch period of, for example, 20.5 samples in an integer value, then the delay of 41 samples, which is twice the pitch period, is likely to be selected, which deteriorates the quality of the reconstructed speech significantly. This is one of the causes of deterioration of the sound quality of a female speech having a short pitch period.

In order to solve the problem, a method of representing a delay (pitch period) in a fractional value has been proposed and is disclosed, for example, in P. Kroon et al., "PITCH PREDICTORS WITH HIGH TEMPORAL RESOLUTION", *Proc. ICASSP*, pp.661–664, 1990 (reference 3). According to this method, a fractional delay is realized to improve the sound quality by oversampling or polyphase filtering an excitation signal.

The method by P. Kroon et al., however, has disadvantages in that a significantly increased amount of calculation is required since, when a delay is to be converted into a fractional value, if the interpolation ratio of 4 is employed, then the calculation amount for a fractional delay in an adaptive codebook become 4 times that for an integer delay.

SUMMARY OF THE INVENTION

It is an object of the present invention to provide a speech coding system which realizes a fractional delay by a small amount of calculation.

In order to attain the object, according to an aspect of the present invention, there is provided a speech coding system, which comprises:

- means for storing a speech signal therein;
- means for dividing the speech signal into a plurality of subframes;
- means for analyzing the speech signal;
- means for perceptually weighting the speech signal;
- means for calculating correlation values between the weighted signal of the current subframe and weighted signals in the past;
- means for finding a plurality of candidates of integer delay in accordance with the correlation values;
- means for determining a fractional delay for each of the candidates with reference to excitation signal in the past; and
- means for extracting an optimum excitation signal from an excitation codebook.

In the speech coding system of the present invention, correlation values between a weighted signal of a current subframe and weighted signals of subframes in the past are first calculated over a predetermined range of pitch period in integer value to find a predetermined plurality of candidates of integer delay in order of magnitude of the correlation values. Then, a fractional delay is found, for a range of delay of several front and rear samples of each of the integer value delay candidates, by polyphase filtering of excitation signal in the past, and that one of the fractional delays which minimizes the error power is selected as a fractional delay. The polyphase filtering method disclosed in reference 3 mentioned hereinabove may be applied to such polyphase filtering.

According to another aspect of the present invention, there is provided a speech coding system, which comprises:

- means for storing a speech signal therein;
- means for dividing the speech signal into a plurality of subframes;
- means for analyzing the speech signal;
- means for perceptually weighting the speech signal;
- means for calculating a predictive residual signal from the speech signal;
- means for calculating correlation values between the predictive residual signal and excitation signal in the past;
- means for selecting a plurality of candidates of integer delay in accordance with the correlation values;
- means for determining a fractional delay for each of the candidates with reference to the excitation signal in the past; and
- means for extracting an optimum excitation signal from an excitation codebook.

In the speech coding system, correlation values between excitation signal in the past and a reverse filter signal (predictive error signal) of an input signal of a subframe are calculated over a predetermined range of pitch period in integer value to find a predetermined plurality of candidates of integer delay in order of magnitude of the correlation values. A fractional delay is found, for several front and rear samples of each of the integer value delay candidates, by polyphase filtering of the excitation signal in the past, and that one of the fractional delays which minimizes the error power is selected as a fractional delay.

According to a further aspect of the present invention, there is provided a speech coding system, which comprises:

means for storing a speech signal therein;

means for dividing the speech signal into a plurality of subframes;

means for analyzing the speech signal;

means for perceptually weighting the speech signal;

means for calculating a predictive residual signal from the speech signal;

means for calculating correlation values between the predictive residual signal of the current subframe and predictive residual signals of subframes in the past;

means for selecting a plurality of candidates of integer delay in accordance with the correlation values;

means for determining a fractional delay for each of the candidates with reference to excitation signal in the past; and means for extracting an optimum excitation signal from an excitation codebook.

In the speech coding system, correlation values between a reverse filter signal (predictive error signal) of a current subframe and residual signals of subframes in the past are calculated over a predetermined range of pitch period in integer value to find a predetermined plurality of candidates of integer delay in order of magnitude of the correlation values. A fractional delay is found, for several front and rear samples of each of the integer value delay candidates, by polyphase filtering of excitation signal in the past, and that one of the fractional delays which minimizes the error power is selected as a fractional delay.

In the operation of the speech coding systems of the present invention described above, if two signals are represented by x(n) and y(n), then an integer delay T is found so that it may minimize the following equation E:

$$E = \sum_n (x(n) - \gamma y(n - T))^2 \tag{1}$$

In this instance, E is minimized when the gain term $\gamma$ is given by the following equation:

$$\gamma = \sum_n x(n)y(y - t) / \sum_n y(n - T)^2 \tag{2}$$

and accordingly, the error power E is minimized when the following equation M is maximum:

$$M = \left( \sum_n x(n)y(n - T) \right)^2 / \sum_n y(n - T)^2 \tag{3}$$

Alternatively, In order to furtiler reduce the calculation amount, the expression:

$$\sum_n x(n)y(n - T) \tag{4}$$

may be used as a correlation value.

After this, a fractional delay is found, for a range of several front and rear samples of each integer value delay candidate, by polyphase filtering of the excitation signal in the past.

Preferably, the determining means determine a plurality of fractional delays for each of the plurality of candidates of integer delay in accordance with the excitation signal in the past, and the extracting means extracts an optimal excitation signal from the excitation codebook in accordance with each of the fractional delays to reconstruct a signal and selects a fractional delay and an excitation signal which minimize the error power between the speech signal and the reconstructed signal.

With the speech coding systems of the present invention, since a plurality of candidates of integer delay are found first by an open-loop, and then a fractional delay is found for a range of several front and rear samples of each candidate by a closed-loop, a significant advantage is achieved in that a high sound quality is obtained by a significantly reduced amount of calculation compared with conventional speech coding systems such as the speech coding system disclosed, for example, in reference 3 mentioned hereinabove.

The above and other objects, features and advantages of the present invention will become apparent from the following description and the appended claims, taken in conjunction with the accompanying drawings in which like parts or elements are denoted by like reference characters.

DESCRIPTION OF THE PREFERRED EMBODIMENTS

Figure 1:
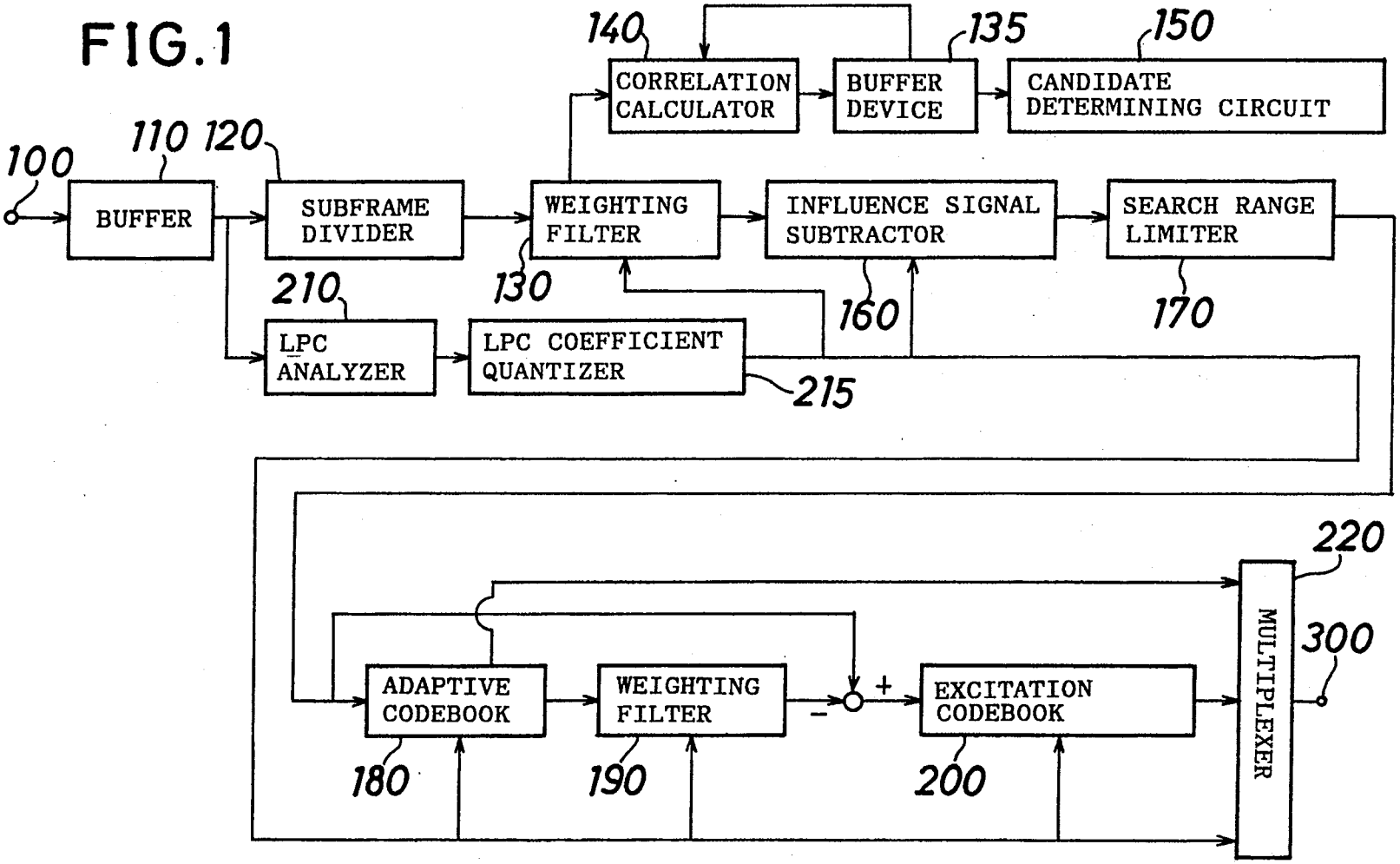
FIG. 1 is a block diagram of a speech coding system showing a first preferred embodiment of the present invention.

Referring first to FIG. 1, there is shown a speech coding system according to a first preferred embodiment of the present invention. The speech coding system includes a buffer device 110 for storing a speech signal therein, a subframe divider 120 for dividing a speech signal stored in the buffer device 110 into a predetermined plurality of subframes, and an LPC (Linear Predictive Coefficient) analyzer 210 for extracting an LPC coefficient, which is a spectrum parameter of speech, from a speech signal for each frame. Existing devices may be employed for the buffer device 110, subframe divider 120 and LPC analyzer 210.

The speech coding system further includes an LPC coefficient quantizer 215 for quantizing an LPC coefficient using any known method. A weighting filter 130 performs a known perceptual weighting operation for a speech signal after the speech signal has been divided into subframes. The method disclosed in reference 1 mentioned hereinabove may be applied to such weighting operation. A correlation calculator 140 calculates correlation values of two different kinds of signals including a weighted signal of a current subframe and weighted signals of subframes in the past in order to allow candidates of integer delay to be determined subsequently. The correlation values here may be obtained from either one of the equations (3) and (4) given hereinabove. A candidate determining circuit 150 selects a predetermined number of candidates of integer delay in order of magnitude of the thus calculated correlation values. An influence signal subtractor 160 subtracts from a weighted signal an influence signal calculated by zero-excitation with an initial condition of a weighted synthesis filter set to the last condition of a weighted synthesis signal of a preceding subframe. A search range limiter 170 sets a section of ±several samples for an integer delay for each of integer delay candidates selected by the candidate determining circuit 150.

A adaptive codebook search circuit 180 performs polyphase filtering of an excitation signal in the past to determine, for a section set by the search range limiter 170, an optimum fractional delay which minimizes the error power. A weighting filter 190 performs synthesization of speech using a filter coefficient obtained by known perceptual weighting of an LPC coefficient obtained by analysis at the LPC analyzer 210. A excitation codebook search circuit 200 performs a search of an excitation codebook. The excitation codebook here may be a noise codebook disclosed in reference 1 mentioned hereinabove or a learned codebook learned in accordance with a VQ (Vector Quantization) algorithm such as an LBG method. As for a method of using such learned codebook, refer to, for example, Japanese Patent Laid-Open Application No. 2-42955 (reference 4) or Japanese Patent Laid-Open Application No. 2-42956 (reference 5). Reference numeral 220 denotes a multiplexer.

In operation, a speech signal is inputted to the speech coding system by way of a speech input port 100 and stored in the buffer device 110. The thus stored signal is LPC analyzed by the LPC analyzer 210 to calculate an LPC coefficient which is a spectrum parameter. The thus calculated LPC coefficient is quantized by the LPC coefficient quantizer 215 and then sent to the multiplexer 220 while it is decoded back into an LPC coefficient, which will be used in processing described below. The speech signal stored in the buffer device 110 is then divided into a predetermined plurality of subframes by the subframe divider 120, and then the following processing is performed for the speech signal for each subframe.

First, perceptual weighting is performed for the speech signal by the weighting filter 130, and then values of the equation (3) or (4) given hereinabove are calculated as correlation values between the weighted signal and weighted signals of subframes in the past by the correlation calculator 140. Then, a predetermined number of candidates of integer delay having maximum values of the equation (3) or (4) are selected by the candidate determining circuit 150 (selection of integer delay candidates by an open loop). After completion of such calculation of correlation values, the weighted signal for the current subframe is stored into the buffer device 135 for a next subframe. The influence signal subtractor 160 calculates an influence signal and subtracts it from the weighted signal. The search range limiter 170 limits a search range of the adaptive codebook to ±several samples of each of the integer delay candidates selected by the candidate determining circuit 150, and the adaptive codebook search circuit 180 performs selection of a fractional delay for each of the search ranges using polyphase filtered excitation signal in the past. A fractional delay which is obtained by such selection and minimizes the error power is determined as an optimum delay of the adaptive codebook, and the optimum fractional delay and a corresponding gain are transmitted to the multiplexer 220. The weighting filter 190 performs synthesization of speech by a weighting synthesizing filter including the gain term using an excitation signal based on the optimum delay of the adaptive codebook and subtracts the thus synthesized signal from the weighting signal. The excitation codebook search circuit 200 searches the excitation codebook for the difference signal obtained by such subtraction. The excitation codebook search circuit 200 then sends an index of an excitation signal of the codebook thus searched out and a corresponding gain to the multiplexer 220. The multiplexer 220 combines outputs of the LPC coefficient quantizer 215, adaptive codebook search circuit 180 and excitation codebook search circuit 200 into a code sequence and outputs the code sequence by way of an output terminal 300. Such processing as described above is repeated for each subframe of the speech signal.

Figure 2:
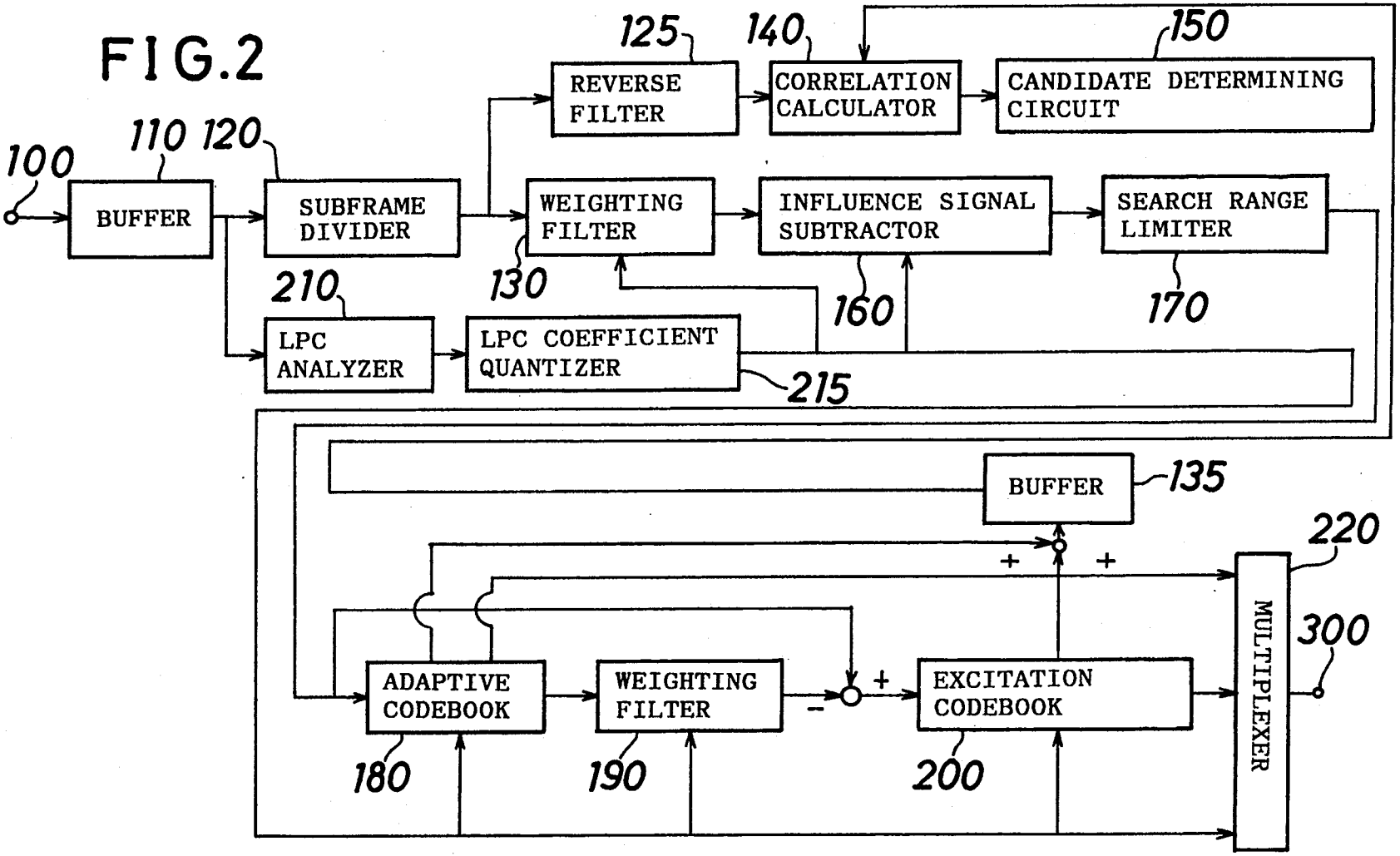
FIG. 2 is a similar view but showing a second preferred embodiment of the present invention.

Referring now to FIG. 2, there is shown a speech coding system according to a second preferred embodiment of the present invention. The speech coding system of this embodiment is a modification to the speech coding system of the first embodiment of FIG. 1 and is only different from the latter in a signal which is used to calculate a correlation value. In particular, in the speech coding system of the present embodiment, a reverse filter 125 serving as a reverse filter to a synthesis filter obtained by an LPC analysis calculates a predictive residual signal from a signal received from the subframe divider 120, and the correlation calculator 140 calculates correlation values between the predictive residual signal and excitation signal of subframes in the past, that is, signals each provided by a sum of signals of the adaptive codebook and the excitation codebook. Accordingly, excitation signal calculated for the subframes and necessary for calculation of a correlation value are stored into a buffer device 135.

Figure 3:
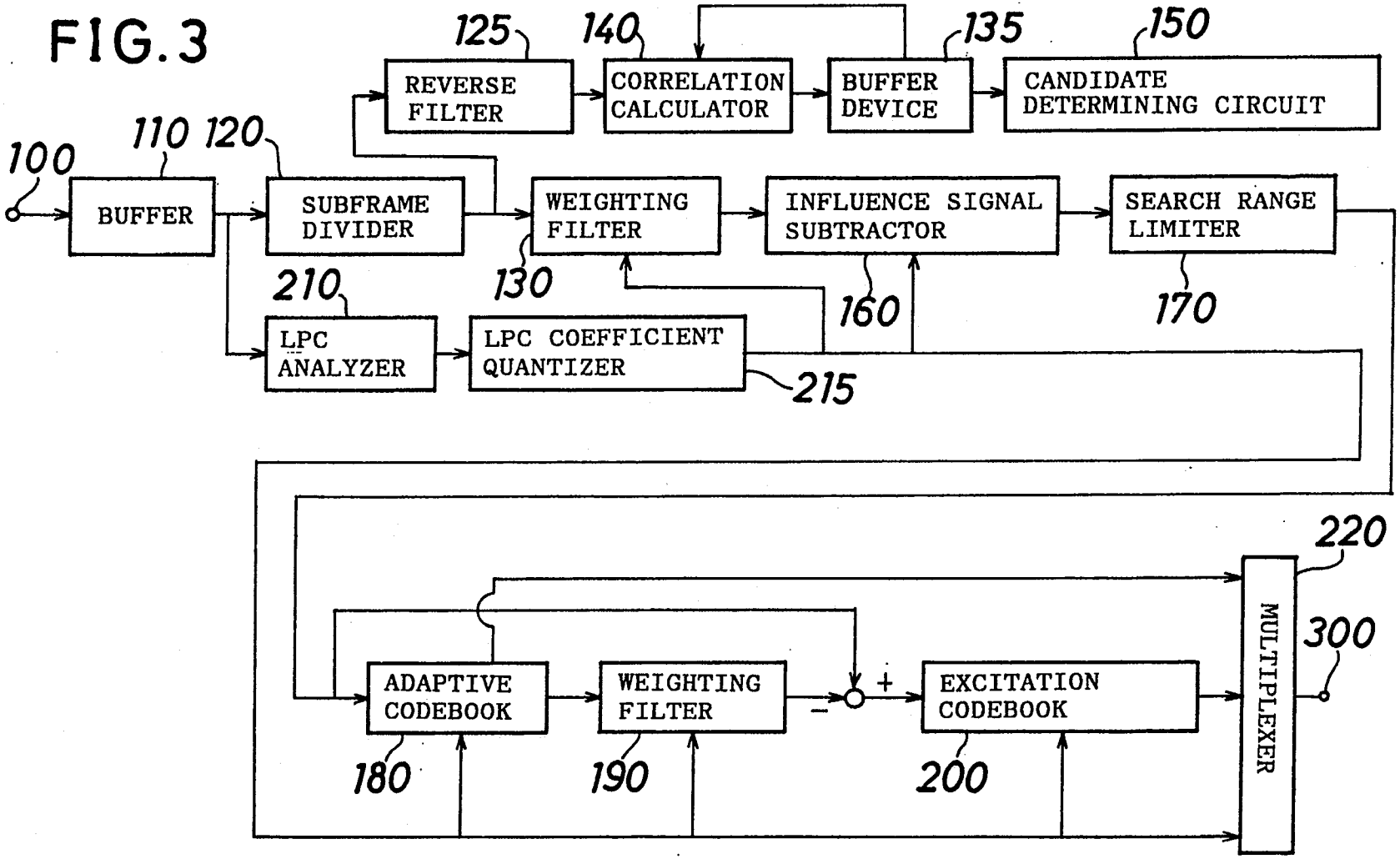
FIG. 3 is a similar view but showing a third preferred embodiment of the present invention.

Referring now to FIG. 3, there is shown a speech coding system according to a third preferred embodiment of the present invention. The speech coding system of the present embodiment is another modification to the speech coding system of the first embodiment of FIG. 1 and is only different from the latter in a signal which is used to calculate a correlation value. In particular, in the speech coding system of the present embodiment, the reverse filter 125 calculates a predictive residual signal of a current subframe, and the correlation calculator 140 calculates correlation values between the predictive residual signal of the current subframe and predictive residual signals of subframes in the past. Accordingly, residual signals calculated for the subframes are stored into the buffer device 135.

After integer delay candidates are determined by any of the speech coding systems of the first to third embodiments described above, a fractional delay is calculated, for each of the candidates, by polyphase filtering for several front and rear samples of the candidate. In this instance, such fractional delay is not determined decisively, but a plurality of different fractional delay candidates are determined temporarily. Then, the excitation codebook is searched for an optimum excitation signal for each of the fractional delay candidates, and a signal is reconstructed using each of the thus fractionally delayed, selected excitation signal. Then, an error power between the input speech and the reconstructed signal is found for each of the fractional delays, and a combination of a fractional delay and an excitation signal of the excitation codebook which minimizes the error power is outputted.

Various modifications can be made to the speech coding systems of the embodiments described above. For example, while a fractional delay of the adaptive codebook and an excitation signal of the excitation codebook are determined decisively for each subframe, they need not be determined decisively for each subframe. For example, they may be determined such that a plurality of candidates are first calculated in order of magnitude of error power from the minimum one for each subframe, and then such candidates are accumulated for the frame to find out an accumulated error power for the entire frame, whereafter a combination of a fractional delay of the adaptive codebook and an excitation signal of the excitation codebook which minimizes the accumulated error power of the entire frame is selected.

Having now fully described the invention, it will be apparent to one of ordinary skill in the art that many changes and modifications can be made thereto without departing from the spirit and scope of the invention as set forth herein.

What is claimed is:

1. A speech coding system for coding a speech signal inputted therein, comprising means for storing a speech signal;

means for dividing the speech signal stored in said means for storing into a plurality of subframes;

means for analyzing the speech signal stored in said means for storing to extract a spectrum parameter from said speech signal for each of said plurality of subframes;

means for perceptually weighing each of said plurality of subframes of the speech signal by using said spectrum parameter to obtain respective weighted signals;

means for calculating correlations to obtain correlation values between a weighted signal of a current subframe and weighted signals of subframes in the past;

means for finding a plurality of candidates of integer delay in accordance with the magnitude of the respective obtained correlation values;

means for determining an optimum fractional delay for each of the plurality of integer delay candidates with reference to an excitation signal in the past;

means for calculating an adaptive code vector calculated by using an excitation signal which is extracted from a sample point represented by said optimum fractional delay, and for subtracting said adaptive code vector from said weighted signal to produce a difference signal; and means for extracting an optimum excitation signal corresponding to said difference signal from an excitation codebook;

wherein said determining means determine a plurality of fractional delays for each of the plurality of candidates of integer delay in accordance with the excitation signal in the past, and said extracting means extracts an optimal excitation signal from the excitation codebook in accordance with each of the fractional delays to reconstruct a signal, calculates an error power between said weighted signal and a reconstructed signal by said fractional delay and said excitation signal, and selects a fractional delay and an excitation signal which minimize said error power.

2. A speech coding system for coding a speech signal inputted therein, comprising:

means for storing a speech signal;

means for dividing the speech signal stored in said means for storing into a plurality of subframes;

means for analyzing the speech signal stored in said means for storing to extract a spectrum parameter from said speech signal for each of said plurality of subframes;

means for perceptually weighing each of said plurality of subframes of the speech signal by using said spectrum parameter to obtain respective weighted signals;

means for calculating a predictive residual signal from the speech signal for each of said plurality of subframes;

means for calculating correlations to obtain correlation values between the respective predictive residual signals and an excitation signal in the past;

means for selecting a plurality of candidates of integer delay in accordance with the magnitude of the respective obtained correlation values;

means for determining an optimum fractional delay for each of the plurality of integer delay candidates with reference to the excitation signal in the past;

means for calculating an adaptive code vector calculated by using an excitation signal which is extracted from a sample point represented by said optimum fractional delay, and for subtracting said adaptive code vector from said weighted signal to produce a difference signal; and means for extracting an optimum excitation signal corresponding to said difference signal from an excitation codebook;

wherein said determining means determine a plurality of fractional delays for each of the plurality of candidates of integer delay in accordance with the excitation signal in the past, and said extracting means extracts an optimal excitation signal from the excitation codebook in accordance with each of the fractional delays to reconstruct a signal, calculates an error power between said weighted signal and a reconstructed signal by said fractional delay and said excitation signal, and selects a fractional delay and an excitation signal which minimize said error power.

3. A speech coding system for coding a speech signal inputted therein, comprising:

means for storing a speech signal;

means for dividing the speech signal stored in said means for storing into a plurality of subframes;

means for analyzing the speech signal stored in said means for storing to extract a spectrum parameter from said speech signal for each of said plurality of subframes;

means for perceptually weighing each of said plurality of subframes of the speech signal by using said spectrum parameter to obtain respective weighted signals;

means for calculating a predictive residual signal from the speech signal for each of said plurality of subframes;

means for calculating correlations to obtain correlation values between the respective predictive residual signal of a current subframe and the predictive residual signals of subframes in the past;

means for selecting a plurality of candidates of integer delay in accordance with the magnitude of the respective obtained correlation values;

means for determining an optimum fractional delay for each of the plurality of integer delay candidates with reference to an excitation signal in the past;

means for calculating an adaptive code vector calculated by using an excitation signal which is extracted from a sample point represented by said optimum fractional delay, and for subtracting said adaptive code vector from said weighted signal to produce a difference signal; and means for extracting an optimum excitation signal corresponding to said difference signal from an excitation codebook;

wherein said determining means determine a plurality of fractional delays for each of the plurality of candidates of integer delay in accordance with the excitation signal in the past, and said extracting means extracts an optimal excitation signal from the excitation codebook in accordance with each of the fractional delays to reconstruct a signal, calculates an error power between said weighted signal and a reconstructed signal by said fractional delay and said excitation signal, and selects a fractional delay and an excitation minimize said error power.

* * * * *